United States Patent [19]

Nicodemus

[11] Patent Number: 4,574,680

[45] Date of Patent: Mar. 11, 1986

[54] ARRANGEMENT IN RECOILLESS WEAPONS

[75] Inventor: Joachim Nicodemus, Cologne, Fed. Rep. of Germany

[73] Assignee: Dynamit Nobel Aktiengesellschaft, Troisdorf, Fed. Rep. of Germany

[21] Appl. No.: 721,930

[22] Filed: Apr. 11, 1985

Related U.S. Application Data

[63] Continuation-in-part of Ser. No. 611,505, May 17, 1984, abandoned, which is a continuation of Ser. No. 333,553, Dec. 22, 1981, abandoned.

[30] Foreign Application Priority Data

Dec. 23, 1980 [DE] Fed. Rep. of Germany ..... 3048597

[51] Int. Cl.[4] ..... F41F 3/02

[52] U.S. Cl. ..... 89/1.701; 89/1.704

[58] Field of Search ..... 89/1.7, 1.701, 1.702, 89/1.703, 1.704, 1.705, 1.706

[56] References Cited

U.S. PATENT DOCUMENTS

| | | | |
|---|---|---|---|
| 1,108,716 | 8/1914 | Davis | 89/1.702 |
| 3,216,323 | 11/1965 | Wengenroth et al. | 89/1.701 |
| 3,771,417 | 11/1973 | Schnabele et al. | 89/1.702 X |

*Primary Examiner*—David H. Brown

*Attorney, Agent, or Firm*—Antonelli, Terry & Wands

[57] ABSTRACT

An arrangement for firing a projectile from a recoilless weapon with a firing barrel open at both of its ends, by means of a propellant charge tamped toward the rear with an inert, pulverulent compensating mass, reduces the noise and the shock waves of the firing. The projectile and the compensating mass are adapted to each other with respect to their mass and the distances to be traversed by each within the firing barrel so that the compensating mass fully vacates the firing barrel only after the projectile vacates the firing barrel.

5 Claims, 5 Drawing Figures

ARRANGEMENT IN RECOILLESS WEAPONS

This application is a continuation-in-part of application Ser. No. 611,505, filed May 17, 1984, now abandoned, which is a continuation of application Ser. No. 333,553, filed Dec. 22, 1981, now abandoned.

The invention relates to an arrangement for firing a projectile from a recoilless weapon; e.g., a bazooka, which has a barrel open at both ends and a propellant charge tamped with a pulverulent compensating mass or material wherein the projectile and the compensating mass are appropriately selected and positioned with respect to the mass of each and the distance of travel of each within the barrel so that the compensating mass leaves the barrel at the rear end after the projectile leaves at the front end.

A weapon is known from U.S. Pat. No. 1,108,714 wherein a projectile is fired toward the front and a compensating mass toward the rear from an equal-caliber barrel open on both ends. The axial forces are herein transmitted to the weapon only by friction of the projectile and/or the compensating mass on the inner wall of the barrel; compressive forces in this case do not contribute toward recoil during firing, and the friction forces can be kept lower by several orders of magnitude than the compressive forces, while the friction forces of the projectile and of the compensating mass, at least in part, compensate each other; for this reason, the so-called "Davis gun" is an essentially recoilless weapon.

A number of special solutions has become known in the course of time with respect to the principle of the Davis gun; for example, this type of weapon has proven itself well as a shoulder weapon in the combating of tanks with hollow-charge projectiles as a "bazooka." In contrast to Davis, however, none of these solutions employs a dimensionally stable compensating mass, but rather one which disintegrates after exiting from the rearward orifice of the barrel of the weapon. All solutions have in common, without exception, that the compensating mass has left the barrel at a point in time when the projectile still must traverse a portion of its route within the barrel of the weapon. This means that these weapons operate as Davis guns merely up to the instant of exiting of the entire compensating mass, whereafter these weapons operate, in contrast, as jet (nozzle) guns with the nozzle expansion ratio of 1.

In the field of recoilless antitank hand weapons, the requirement is being posed to an increasing extent of firing these weapons from closed spaces (e.g., rooms). However, a deterent to realizing this requirement is the problem of endangering the person firing the weapon; this danger, ensuing when firing from closed spaces practically and exclusively from the rearward opening of the recoilless weapon, can be divided into two categories; namely, danger on account of the firing noise and danger on account of the resulting shock waves. The noise can have such an intensity that even with the use of ear protectors adapted for field conditions, the person firing the weapon will suffer damage. Also, the shock waves can reach such an intensity that the gunner is injured and, in some instances, even the walls of the room are damaged.

It is an object of th invention to provide a solution for permitting firing of the weapon also from enclosed spaces; i.e., avoiding the above-mentioned dangers when firing from enclosed spaces. According to the invention, this is achieved by an arrangement wherein the compensating mass is caused to leave the weapon after the projectile has left; i.e., by the feature that the projectile and the compensating charge are constructed with respect to their mass and the distances to be traversed in the barrel so that the compensating mass fully vacates the barrel, preferably only after the projectile has left the weapon.

According to another proposal by this invention, the compensating mass is arranged in the firing barrel in such a manner to provide an annular gap between this mass and the barrel. As a consequence, friction between the surface of the compensating mass and the inner surface of the barrel is considerably reduced because a portion—though a minor portion—of the powder gases resulting from firing of the propellant can flow through the annular gap to the rearward barrel mouth and exit therefrom. Since, in the annular gap especially if it has a relatively large length, the throughflowing gas experiences a considerable pressure drop, no appreciable bang or noise occurs in spite thereof, much less is there a shock wave. Although, while the compensating mass is exiting and, thus, becomes shorter, the amount of powder gases flowing past this mass becomes larger, there is yet no possibility of formation of a nonsteady state, since the total process takes place continuously in spite of its temporal brevity.

In order to provide uniform and reproducible conditions, the compensating mass is retained centrally in the barrel by means of spacer elements arranged distributed over its circumference. The spacer elements are preferably continuous and extend in axial directions over the whole length of the tubular casing for the compensating mass so that several segment-like gaps are formed around the mass. But it is also possible to use two or more discrete spacer elements distributed over the length of the casing instead of the continuous element. This ensures that the desired purpose of reducing the size of the friction coefficient is attained in the best possible fashion.

In yet another embodiment of the invention, the compensating mass does not fill out the entire cross-section of the tubular barrel of the weapon; i.e., the mass is also provided with a small central axial continuous duct or passage. This duct allows the powder gases, resulting from the propellant charge, to penetrate into the compensating mass and can cause the mass to undergo spontaneous deterioration after exiting from the rear end of the weapon. In this embodiment, as in other embodiments, the main mass of powder gases comes out of the front muzzle of the barrel while only a small minimal part or quantity of the gases discharge out of the rear of the weapon.

The invention is illustrated in the drawings and will be described below with reference thereto.

Figure 1:
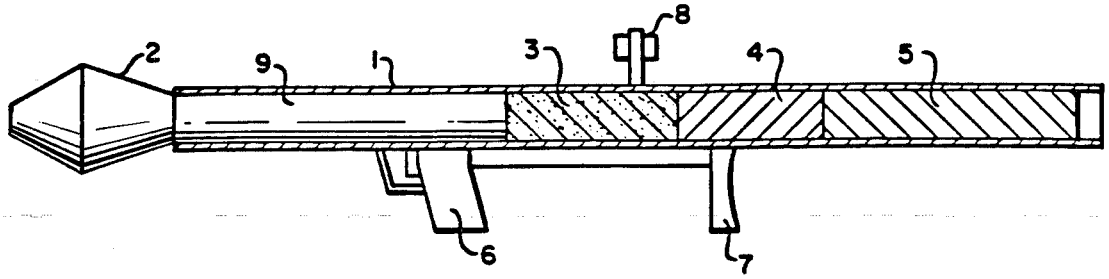
FIG. 1. PRIOR ART
FIG. 1 shows, using a bazooka as an example, the schematic view of a modern recoilless weapon in a sectional illustration.

In FIG. 1, numeral 1 is the barrel of the recoilless weapon, the projectile 2 being inserted at its shank 9 into the barrel. The gun chamber with the propellant charge 3 is located behind the bottom end of the projectile shank 9. A compensating mass 4 formed of, e.g., iron powder, in a tubular cardboard casing disposed on the side of the propellant charge 3 facing away from the projectile can, optionally, be enlarged by an additional compensating mass 5. The pistol grip 6 for triggering the ignition of the propellant charge or the firing of the shot; the shoulder rest 7; and the gun sight 8 complete the weapon.

Figure 2:
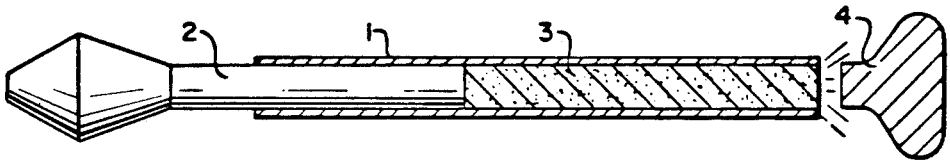
FIG. 2. PRIOR ART
FIG. 2 shows, likewise in a sectional view, the relationships in a recoilless weapon designed according to conventional practice.

With a conventional design of the compensating mass, the behavior of projectile and compensating mass, as illustrated in FIG. 2, results when the projectile is fired; in other words, the projectile 2 will still be within the barrel 1 with a substantial portion of its shank 9 after, as shown, the propellant charge 3, now in the form of powder gases, has completely occupied the remaining space of the barrel 1, and the compensating mass 4 has left the barrel and begins to disintegrate.

Figure 3:
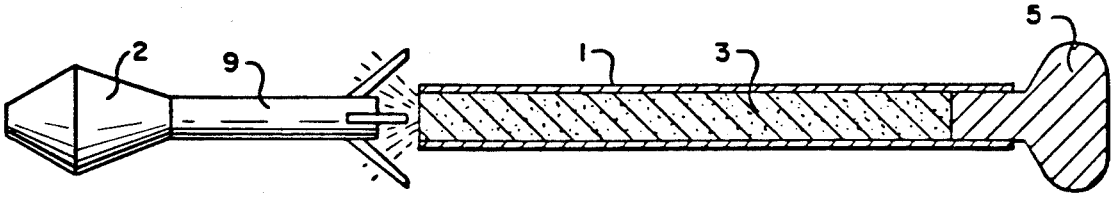
FIG. 3 shows a weapon constructed according to this invention.

In contrast to the above, the behavior is different with an arrangement according to this invention as illustrated in FIG. 3. In this case, part of the compensating mass 5 is still within the barrel, which is otherwise completely filled with the pressure gases produced from the propellant powder charge 3; whereas the projectile 2 has, in its entirety, already exited from the barrel and the powder gases behind the projectile discharge into the outside air.

Figure 4:
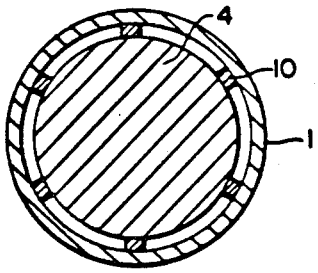
FIG. 4 shows, in a schematic representation, a different embodiment of the invention for the arrangement of the compensating mass in the barrel of the weapon.

According to FIG. 4, the compensating mass 4 is disposed centrally in the barrel 1 of the weapon with the aid of the spacer elements 10 arranged and distributed over its circumference, leaving an annular-like gap.

Figure 5:
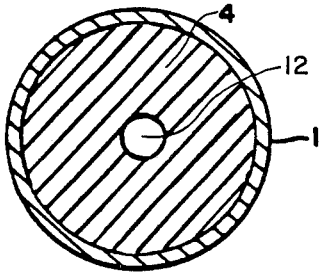
FIG. 5 shows, in a schematic representation, yet another embodiment of the invention for the arrangement of the compensating mass in the barrel of the weapon.

According to FIG. 5, the compensating mass is provided with a small central continuous duct or passage 12 which, as heretofore described, allows the powder gases to penetrate into the mass 4 and cause its spontaneous deterioration after exiting from the rear end of the weapon.

Numerous different pulverulent materials can be used, as is well known, for the disintegrating compensating mass. It is also known to add binding, lubricating, etc., subtances to the pulverulent materials to achieve special results. For example, poured iron powder or a material as described in DE-OS No. 22 60 625 (German Unexamined Laid-Open Application) can be used. The mass of the compensating mass and/or the distance the latter one has to traverse in the barrel when firing the projectile have to be so large in relation to the same parameters of the projectile, that the compensating mass fully vacates the firing barrel only after the projectile has left the barrel. This can be determined in a rather simple way by some practical shooting tests. Under otherwise unchanged conditions, the mass of the compensating mass can be the smaller, the larger the distance which has to be traversed by the compensating mass within the barrel. On the other hand, the mass has to be the larger, the easier the compensating mass disintegrates on leaving the barrel because its already disintegrated part has no longer a compensating effect during the further firing process.

I claim:

1. An arrangement for firing a projectile from a weapon with a firing barrel that is open at both ends, by a propellant charge tamped toward the rear with an inert, pulverulent compensating mass, characterized in that the projectile and the compensating mass are adapted to each other with respect to their mass and the distances to be traversed by each within the firing barrel in such a way that the compensating mass fully vacates the firing barrel only after the projectile vacates the firing barrel.

2. An arrangement according to claim 1, characterized in that the compensation mass is provided with a small central continuous axially extending duct to allow penetration of powder gases therein.

3. An arrangement according to claim 1, characterized in that the compensating mass is arranged in the firing barrel to provide an annular gap between its surface and the inner surface of the firing barrel.

4. An arrangement according to claim 3, characterized in that the compensating mass is disposed centrally in the barrel by spacer elements distributed over its circumference.

5. An arrangement according to claim 4, characterized in that the spacer elements are continuous and extend in the axial direction over the entire length of the compensating mass whereby a plurality of segment-like gaps are formed around the mass.

* * * * *